US006283195B1

(12) United States Patent
Chandley et al.

(10) Patent No.: US 6,283,195 B1
(45) Date of Patent: Sep. 4, 2001

(54) PASSIVATED TITANIUM ALUMINIDE TOOLING

(75) Inventors: George D. Chandley, Amherst, NH (US); Curtis A. Harrison, Flint, MI (US); Qi Zhao, Nashua, NH (US)

(73) Assignee: Metal Casting Technology, Incorporated, Milford, NH (US)

( * ) Notice: Subject to any disclaimer, the term of this patent is extended or adjusted under 35 U.S.C. 154(b) by 0 days.

(21) Appl. No.: 09/243,292

(22) Filed: Feb. 2, 1999

(51) Int. Cl.[7] ..... B22D 13/00

(52) U.S. Cl. ..... 164/113; 164/312; 72/462; 428/472.1; 428/472.2

(58) Field of Search ..... 164/113, 312; 72/462, 467; 428/472.2, 472.1

(56) References Cited

U.S. PATENT DOCUMENTS

| | | | |
|---|---|---|---|
| 2,881,105 | 4/1959 | Gullett | 148/6.3 |
| 4,500,605 | 2/1985 | Fister et al. | 428/469 |
| 5,020,778 | 6/1991 | Thibault et al. | 266/89 |
| 5,431,754 | 7/1995 | Fujiwara et al. | 148/669 |
| 5,451,366 | 9/1995 | Kumagai et al. | 420/418 |
| 5,474,282 | 12/1995 | Eckert | 266/280 |
| 5,547,769 | 8/1996 | Schmitz | 428/653 |
| 5,635,303 | 6/1997 | Retallick | 428/472.2 |
| 5,672,436 | 9/1997 | Tobin | 428/629 |
| 5,865,238 * | 2/1999 | Carden et al. | 164/113 |
| 5,974,850 * | 11/1999 | Huang et al. | 72/467 |

FOREIGN PATENT DOCUMENTS

| | | | |
|---|---|---|---|
| 1-289556 * | 11/1989 | (JP) | 164/134 |
| 7-18360 * | 11/1989 | (JP) . | |
| 7-197155 * | 8/1995 | (JP) . | |

OTHER PUBLICATIONS

Behavior of Metal Alloys in the Semisolid State; Metallurgical Transactions A, vol. 22A, May 1991, pp. 957, 970–972, 981; M.C. Flemings.

* cited by examiner

*Primary Examiner*—Kuang Y. Lin

(57) ABSTRACT

Tooling for handling molten or hot solid aluminum and its alloys wherein the tooling is made of a passivated titanium aluminide (TiAl) intermetallic compound having a thin passivating surface oxide film formed in-situ thereon by contact with an oxygen-bearing atmosphere at elevated temperature. The surface oxide film passivates and renders the tooling non-wetted by and non-reactive with molten aluminum and its alloys and non-bonded to hot solid aluminum and its alloys.

14 Claims, 3 Drawing Sheets

40
52
42
14a
14
50
EP
30
34
33
32
10
T
M
VP
P
20
12
16
18
19

PASSIVATED TITANIUM ALUMINIDE TOOLING

FIELD OF THE INVENTION

The present invention relates to tooling for handling molten and hot solid aluminum and its alloys in manufacture of products therefrom.

BACKGROUND OF THE INVENTION

In the making of metal matrix composites (MMC's) comprising fine ceramic (e.g. alumina) reinforcement particles dispersed in a matrix comprising aluminum or its alloys, a semi-solid slurry (a thixotropic liquid/solid mixture) of the aluminum matrix material is formed in a refractory crucible, and the ceramic reinforcement particles are introduced into the aluminum slurry and mechanically mixed therein by a rotating mixing blade. Introduction of the ceramic reinforcement particles into the semi-solid aluminum slurry enables a high volume percentage, such as 30–40 volume %, of reinforcement particles to be dispersed in the aluminum matrix of the final MMC. Such an MMC process is described in the Flemings U.S. Pat. No. 3,948,650.

The mixing blade used to mechanically mix the ceramic reinforcement particles into the semi-solid aluminum slurry is subjected to tremendous abrasive action from the ceramic particles as they are dispersed in the semi-solid slurry. Expensive flame sprayed alumina coated stainless steel (Type 304) mixing blades used in the past typically exhibit catastrophic wear after only 30 minutes such that replacement with a new mixing blade is required.

There is a need for improved mixing blades for use in the manufacture of MMC's using semi-solid slurries as well in other manufacturing applications that process or handle molten or hot solid aluminum and its alloys.

An object of the present invention is to satisfy this need.

SUMMARY OF THE INVENTION

The present invention provides in one embodiment tooling for handling molten or hot solid aluminum and its alloys wherein the tooling comprises passivated titanium aluminide (TiAl) intermetallic compound having a thin passivating surface oxide film formed in-situ thereon by contact with an oxygen-bearing atmosphere at elevated temperature. The surface oxide film passivates and renders the tooling non-wetted by and non-reactive with molten aluminum and its alloys and non-bonded to hot solid aluminum and its alloys.

Passivated titanium aluminide intermetallic tooling having the thin surface oxide film formed in-situ thereon can comprise a mixing blade for making MMC's in the manner described above and also can comprise other tooling. For example, passivated titanium aluminide intermetallic tooling having the thin surface oxide film formed in-situ thereon can comprise hot die casting machine components, such as hot shot sleeves, plungers and dies, hot extrusion die components such as extrusion dies, and holders for molten aluminum filters in permanent mold casting. The passivated titanium aluminide intermetallic tooling advantageously exhibits a coefficient of thermal expansion that is comparable to that of H13 tool steel such that the titanium aluminide intermetallic tooling can be inserted in or mated with larger tooling or machine components made of H13 tool steel to provide a local tooling component that is non-wetted or non-bonded by molten or hot solid aluminum and its alloys.

The above and other objects and advantages of the present invention will become more readily apparent from the following drawings taken in conjunction with the following detailed description.

DESCRIPTION OF THE INVENTION

Figure 1:
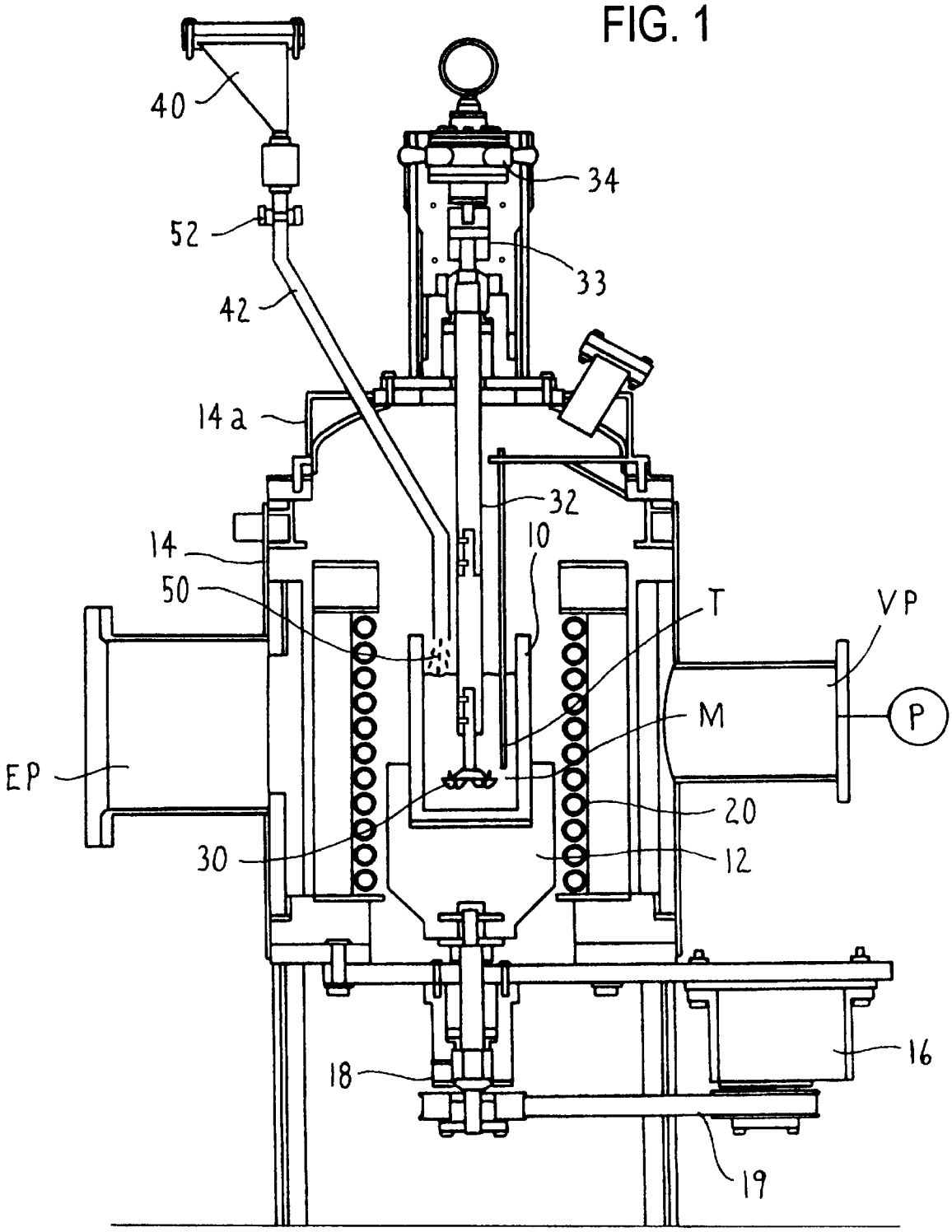
FIG. 1 is a schematic view of apparatus for making a MMC by mixing ceramic reinforcement dispersoids in a semi-solid slurry comprising aluminum using a passivated titanium aluminide mixing blade of the invention.

FIG. 1 illustrates schematically apparatus for making a metal matrix composite (MMC) by mixing ceramic reinforcement dispersoids in a semi-solid slurry comprising aluminum using a passivated titanium aluminide mixing blade pursuant to an embodiment of the invention. For example, the apparatus is shown comprising a mixing container 10, such as a refractory crucible, from which the semi-solid slurry mixed with ceramic reinforcement dispersoids is countergravity cast into a mold (not shown) as described, for example, in U.S. Pat. No. 5,042,561, the teachings of which are incorporated herein by reference. The mixing container 10 is disposed on a rotary ceramic table 12 in a vacuum chamber 14 connected by conduit or port VP to a conventional vacuum pump P. The rotary table is rotated by a motor 16 and belt 19 through a vacuum sealed bearing 18. An induction coil 20 is positioned in the chamber 14 about the crucible 10 to inductively heat a solid charge comprising aluminum or aluminum alloy (hereafter referred to as aluminum charge). The induction coil 20 receives electrical power via electrical cables (not shown) that pass through electrical power port EP. The solid aluminum charge is positioned in the crucible 10 comprising silicon carbide ceramic material substantially non-reactive with molten aluminum charge and is melted in air by energization of the induction coil 20. After the aluminum charge is melted, a lid or cover 14*a* of the vacuum chamber 14 is lowered and vacuum tight sealed on the chamber 14. A relative vacuum (subambient pressure) then is drawn in chamber 14 by actuation of the vacuum pump P. A typical vacuum level of 0.050 to 0.080 torr is provided in chamber 14.

Energization of the induction coil 20 then is controlled in a manner to cool the melted aluminum charge M to form a semi-solid aluminum slurry comprising a partly solid/partly liquid charge (i.e. thixotropic slurry). For aluminum alloy 356 (nominally comprising 7 weight % Si, 0.3 weight % Mg and balance aluminum), the aluminum charge is melted (melting temperature of 1135 degrees F) and is cooled while stirring with mixer blade 30 to 1110 degrees F by controlled de-energization/energization of the induction coil 20 to form the semi-solid slurry in the crucible 14. As the melted aluminum charge is cooled, it is mixed by rotation of the table 12 and mixer blade 30 to provide a thixotropic slurry comprising about 30% to 40% by volume solid phase and balance liquid phase, although the invention is not limited to these percentages of solid/liquid phases in the slurry. The mixer blade 30 is fastened to and rotated by shaft 32 extending through the lid 14*a* and a drive train 33 coupled to a suitable motor 34 outside of the chamber 14. The temperature of the semi-solid aluminum slurry is determined by thermocouple T.

Preheated ceramic reinforcement powder 50 is introduced from a hopper 40 outside of chamber 14 through a supply tube 42 extending into the chamber 14 to overlie the crucible 10. The hopper 40 is evacuated to the same vacuum level as is provided in the chamber 14 before the preheated reinforcement powder 50 is introduced into the crucible 10. A conventional pinch valve 52 between the hopper 40 and the supply tube 42 is opened to supply the preheated powder to the crucible. The preheated reinforcement powder is introduced under the same vacuum as in chamber 10 to ensure that the powder is dry and flows smoothly onto the top of the aluminum slurry in the crucible 10.

An illustrative reinforcement powder for use in making MMC's comprises alumina powder having particle size in the range of 5 to 20 microns diameter, although practice of the invention is not limited to any particular reinforcement powder or any particular particle size range. Other reinforcement powder which can be used in making MMC's include, but are not limited to, silicon carbide and other ceramic particles. The reinforcement powder is rapidly mixed into the semi-solid aluminum slurry in the crucible 10 by combined rotation of the table 12 and the mixer blades 30. After thorough mixing, the aluminum/particle slurry is heated by induction coil 20 to the liquid aluminum temperature range for casting. The liquid aluminum melt having the reinforcement powder mixed therein then is cast from the crucible 10 by removing lid 14*a* and immersing a suction tube (not shown) in the liquid aluminum/dispersed powder charge in the crucible and countergravity casting the charge into an evacuated ceramic shell or other casting mold positioned thereabove as described in U.S. Pat. No. 5,042,561, whose teachings are incorporated herein by reference to this end.

In accordance with an embodiment of the invention, the mixer blade 30 comprises a passivated titanium aluminide intermetallic compound or alloy. For example, the mixer blade 30 can be made of investment cast titanium aluminide intermetallic alloy comprising, nominally by weight, 0.1% maximum C, 0.2% maximum Mn, 0.1% maximum Cu, 0.1% maximum Ni, 0.5% Cr, 1.0% Nb, 33.5% Al, 0.25% O,0.02% N and balance essentially Ti. The mixer blade 30 can be passivated by cooling the hot investment casting in air or reheating the casting above about 800 degrees F. in air to form a suitable surface oxide film in-situ on the blade surfaces. The surface oxide film is formed in a thickness range of about 1 micron to 100 microns and passivates the blades 30 in a manner that renders them non-wetted by and nonreactive with the molten aluminum constituent of the slurry and non-bonded to hot solid constituent of the slurry in the crucible 10. The passivating surface film can be formed on the mixer blade 30 by cooling as-cast blades while hot to ambient temperature in air and using the mixer blade in the as-cast and oxidized (passivated) condition. Alternately, the surface film can be formed by machining cast mixer blade to desired configuration followed by heating the machined mixer blade to an elevated temperature such as from about 800 degrees F. up to 1000 degrees F. and above in air or other oxygen bearing atmosphere for a time (e.g. 30 minutes at 900 degrees F.) effective to form the passivating surface film.

The passivating surface film forms naturally and is thought to comprise an outer $TiO_2$ outer layer, an intermediate layer including $TiO_2$ and $Al_2O_3$, and an inner $Ti_3Al$ layer next to the base alloy when the surface film is formed with higher film thicknesses near 100 microns thickness. However, the composition of the passivating surface layer is less important than its ability, regardless of surface film composition, to render the titanium aluminide mixing blades non-wetted by and non-reactive with the molten aluminum charge constituent.

Various titanium-aluminum intermetallic alloys can be used in practice of the invention. The intermetallic alloys typically comprise predominantly gamma phase TiAl alloys but they also may include a minor amount of alpha phase (e.g. up to 15 volume % alpha phase) . Titanium-aluminum intermetallic alloys comprising about 30% to 35% by weight Al and 55% to 65% by weight Ti can be used in practice of the invention and may include one or more alloying elements such as W, Nb, Cr, Si, B, V and others depending on particular temperatures and stresses to be encountered in service. Various titanium-aluminum intermetallic alloys are described in U.S. Pat. No. 4,879,092 and other patents.

To illustrate advantageous features of the invention, a mixer blade made of the above passivated titanium aluminide alloy was rotated at 3500 rpm in a semi-solid slurry comprising aluminum alloy 356 and 35 volume % alumina particles for 3 hours without any observable wear of the blade. Similarly, another mixer blade made of the above passivated titanium aluminide alloy was rotated at 2000 rpm in a semi-solid slurry comprising aluminum alloy 356 and 35 volume % alumina particles for 40 minutes without any observable wear of the blade. In contrast, a mixer blade made of Type 304 stainless steel flame sprayed with alumina was rotated at 3500 rpm in a semi-solid slurry comprising aluminum alloy 356 and 35 volume % alumina particles for 30 minutes and exhibited such extreme wear as to render the blade unusable and in need of replacement. The stainless steel mixer blade was missing several radial blades and portions of the blade hub from which the blades extend.

Figure 2:
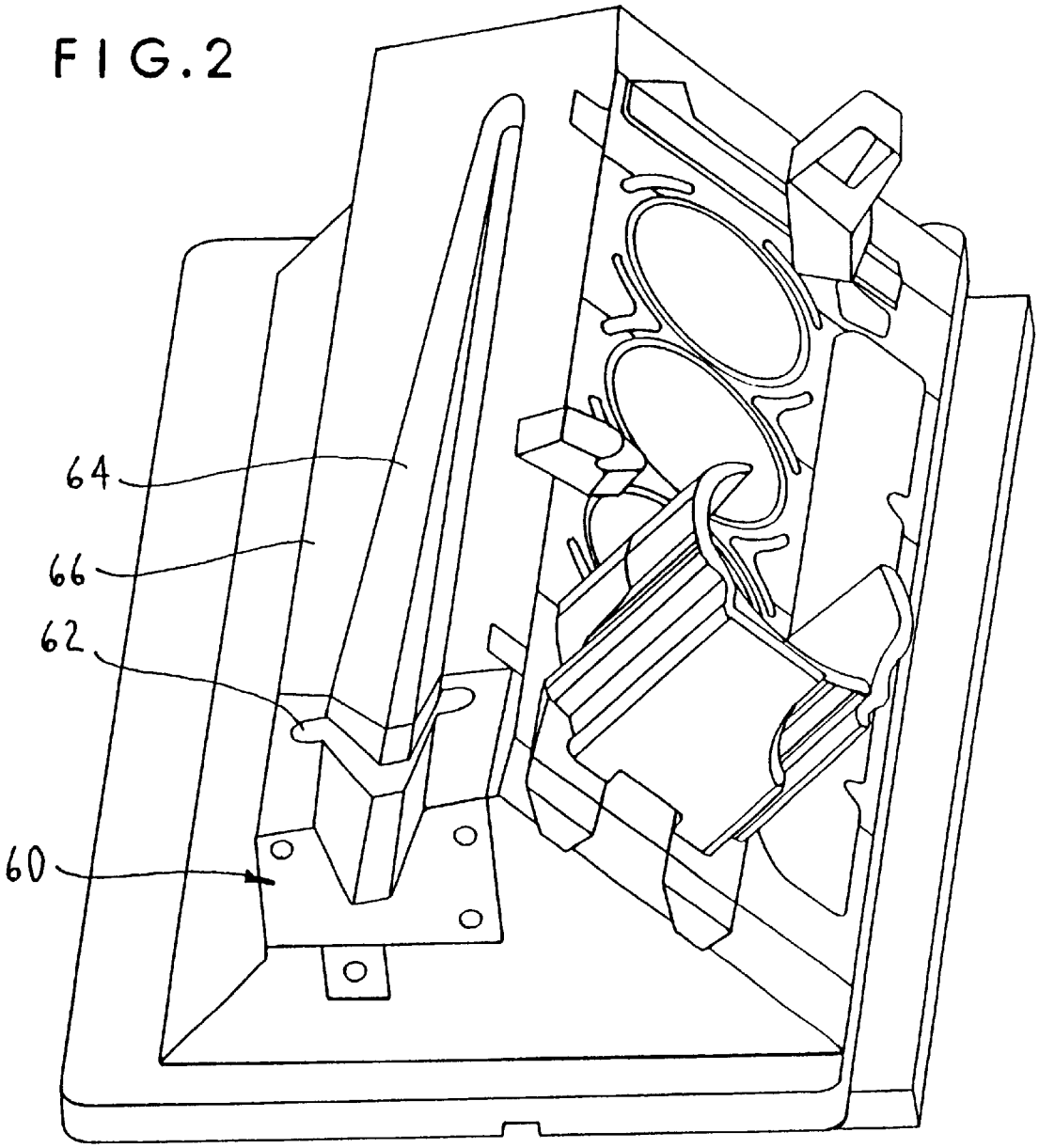
FIG. 2 is a schematic view of apparatus for permanent mold casting of aluminum alloy automobile engine blocks including a passivated titanium aluminide insert of the invention for holding a molten metal filter.

FIG. 2 is a schematic view illustrating apparatus for permanent mold casting of aluminum alloy automobile engine blocks including a passivated titanium aluminide insert 60 of the invention having a slot 62 in which a molten metal filter (not shown) is received for removing inclusions and dirt/debris from molten aluminum supplied to casting mold 66 via a runner 64. In this application, the passivated titanium aluminide insert 60 made of the passivated titanium aluminide alloy described above was tested for 1000 casting cycles before replacement of the insert was required. In contrast, an insert made of H13 tool steel typically must be replaced after about 200 casting cycles as a result of aluminum sticking to the insert and cracking of the insert. A 500% to 600% improvement in life of the insert was thereby achieved by practice of the invention.

Figure 3:
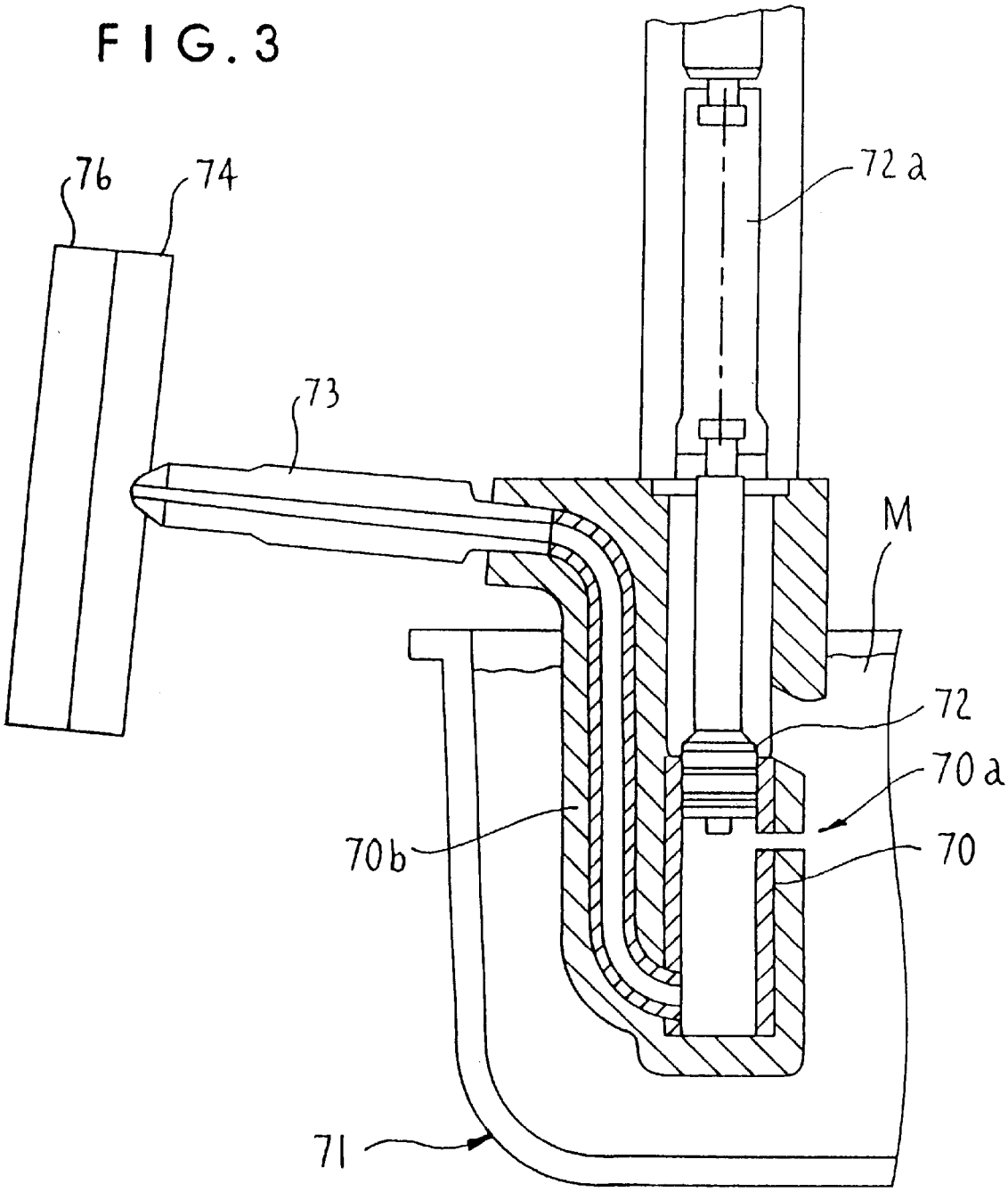
FIG. 3 is a schematic view of aluminum die casting apparatus having a shot sleeve, plunger and hot dies comprising passivated titanium aluminide.

FIG. 3 is a schematic view of aluminum die casting apparatus having a shot sleeve 70 and plunger 72. The shot sleeve 70 receives molten aluminum from vessel 71 via shot sleeve opening 70*a*. Shot sleeve 70 includes shot sleeve extension 70*b* that communicates to an injector 73 through which molten aluminum is supplied to a die cavity (not shown) defined between relatively movable die halves 74, 76, which are closed together to cast an aluminum charge into the die cavity and opened to remove a die casting therefrom. Die halves 74, 76 can be comprised partly or fully of passivated titanium aluminide pursuant to another embodiment of the invention in order to achieve improved service lives of these die cast machine components. For example, the surfaces of the die halves 74, 76 contacting the molten aluminum comprise passivated titanium aluminide as die inserts. A molten aluminum charge is injected under pressure into the die cavity after the dies halves 74,76 are closed by movement of the plunger 72 in the shot sleeve 70.

Plunger 72 is moved by a fluid or other actuator (not shown) via shaft 72*a*. The dies halves 74, 76 can be heated by a conventional heating device to an elevated temperature, such as 800 degrees F, to improve the quality of the die cast parts formed in the die cavity. The passivated titanium aluminide components provide improved service lives in the hot die casting of aluminum and aluminum alloy components. Service life improvement also can be achievable in hot extrusion of solid aluminum and its alloys by using hot extrusion dies comprising a passivated titanium aluminide intermetallic tooling. For example, a method of making an extrusion is contemplated wherein a heated solid aluminum or aluminum alloy body is forced through an extrusion die comprising a passivated titanium aluminide intermetallic compound having a surface oxide film formed in-situ thereon by contact with an oxygen-bearing atmosphere at elevated temperature to render the extrusion die surface in contact with the hot solid aluminum non-bonded thereby.

The passivated titanium aluminide intermetallic tooling of the invention is further advantageous in that such tooling is used without any need to coat the tooling with a bulk protective coating of any kind. That is, the oxide surface film formed in-situ on the tooling comprises the sole passivating surface film on the tooling of the invention and is advantageous to yield more dimensionally precise parts or components.

The passivated titanium aluminide intermetallic tooling of the invention is still further advantageous in that such tooling exhibits a coefficient of thermal expansion (e.g. 11.7 to 12.2 microns/meter/degrees C) that is comparable to that of H13 tool steel such that the passivated titanium aluminide intermetallic tooling can be inserted in or mated with larger tooling or machine components made of H13 tool steel to provide a local tooling component that is non-wetted or non-bonded by molten or hot solid aluminum and its alloys. That is, the passivated titanium aluminide tooling can be used as a local machine component at a location where service conditions are too severe for an H-13 tool steel component.

Although the invention has been described in detail above with respect to certain embodiments, those skilled in the art will appreciate that modifications, changes and the like can be made therein without departing from the spirit and scope of the invention as set forth in the appended claims.

What is claimed is:

1. In a method of making a metallic article comprising aluminum and its alloys, the improvement comprising contacting said aluminum and its alloys in at least one of the molten state and hot solid state with tooling selected from the group consisting of a passivated titanium aluminide compound and alloy having a surface oxide film formed in-situ thereon by contact at elevated temperature with an oxygen-bearing atmosphere.

2. In a method of making a metal matrix composite wherein ceramic reinforcement particles are mixed in a semi-solid slurry comprising aluminum and its alloys, the improvement comprising mixing said particles in said slurry using a mixer blade tooling selected from the group consisting of a passivated titanium aluminide compound and alloy having a surface oxide film formed in-situ thereon by contact at elevated temperature with an oxygen-bearing atmosphere.

3. The method of claim 2 wherein said compound comprises predominantly gamma TiAl.

4. The method of claim 2 where said alloy comprises titanium aluminide including at least one other alloying element.

5. In a method of making a die casting wherein a melt comprising aluminum is introduced into a shot sleeve and injected into a die by a plunger, the improvement comprising introducing said melt into the die selected from the group consisting of a passivated titanium aluminide compound and alloy having a surface oxide film formed in-situ thereon by contact at elevated temperature with an oxygen-bearing atmosphere.

6. The method of claim 5 wherein said compound comprises predominantly gamma TiAl.

7. The method of claim 5 where said alloy comprises titanium aluminide including at least one other alloying element.

8. In a method of making an extrusion wherein a heated body comprising aluminum is forced through an extrusion die, the improvement comprising forcing said body through said die selected from the group consisting of a passivated titanium aluminide compound and alloy having a surface oxide film formed in-situ thereon by contact at elevated temperature with an oxygen-bearing atmosphere.

9. The method of claim 8 wherein said compound comprises predominantly gamma TiAl.

10. The method of claim 8 where said alloy comprises titanium aluminide including at least one other alloying element.

11. In a method of making a casting wherein a melt comprising aluminum is introduced through a molten metal filter into a mold, the improvement comprising positioning said molten metal filter in a holder selected from the group consisting of a passivated titanium aluminide compound and alloy having a surface oxide film formed in-situ thereon by contact at elevated temperature with an oxygen-bearing atmosphere.

12. The method of claim 11 wherein said melt is cast into a permanent metal mold.

13. The method of claim 11 wherein said compound comprises predominantly gamma TiAl.

14. The method of claim 11 where said alloy comprises titanium aluminide including at least one other alloying element.

* * * * *